United States Patent [19]

Nagaishi et al.

[11] 4,183,339

[45] Jan. 15, 1980

[54] ELECTROSTATIC FUEL ATOMIZING APPARATUS FOR INTERNAL COMBUSTION ENGINE

[75] Inventors: Hatuo Nagaishi; Suzuo Suzuki, both of Yokosuka, Japan

[73] Assignee: Nissan Motor Company, Limited, Japan

[21] Appl. No.: 843,025

[22] Filed: Oct. 17, 1977

[30] Foreign Application Priority Data

Oct. 18, 1976 [JP] Japan ..... 51-123854

[51] Int. Cl.[2] ..... F02B 51/04; F02B 33/00

[52] U.S. Cl. ..... 123/119 E; 123/119 EC; 123/139 AW

[58] Field of Search ..... 123/119 E, 119 EC, 139 AW

[56] References Cited

U.S. PATENT DOCUMENTS

| | | | |
|---|---|---|---|
| 4,034,728 | 7/1977 | Saufferer et al. | 123/119 E |
| 4,056,932 | 11/1977 | Naramura et al. | 123/119 EC |
| 4,082,070 | 4/1978 | Saufferer et al. | 123/119 E |
| 4,089,311 | 5/1978 | Brettschneider et al. | 123/119 EC |
| 4,103,649 | 8/1978 | Matumoto et al. | 123/119 EC |

*Primary Examiner*—Wendell E. Burns

*Attorney, Agent, or Firm*—Lane, Aitken & Ziems

[57] ABSTRACT

A piston slidably received in a tubular housing is movable in response to the instantaneous flow of intake air to vary the number of small diameter tubes through which fuel can be jetted under the influence of a variable electrostatic force induced by the application of a variable high voltage across an electrode immersed in the fuel upstream of the nozzles and an electrode arranged about and spaced from the tubular housing.

21 Claims, 8 Drawing Figures

ELECTROSTATIC FUEL ATOMIZING APPARATUS FOR INTERNAL COMBUSTION ENGINE

FIELD OF THE INVENTION

The present invention relates generally to an air-fuel delivery system and more particularly to a fuel atomizing apparatus for an air-fuel delivery system which employs electrostatic attraction and repulsion to induce fuel to jet or spray into a flow of air to form a combustible mixture.

BACKGROUND OF THE INVENTION

Air-fuel delivery systems can be broadly classified into two groups, fuel injection and carburetion.

In the case of fuel injection, there are two basic types of systems, one which combines the pump and injector into a single unit and the other which has an independent pump which feeds a plurality of electronically or otherwise operated injectors.

Although the above described systems are able to accurately inject fuel with respect to time and quantity, they suffer from drawbacks including complex construction and high cost.

In the case of carburetion, modern carburetors, due to the ever-increasing demand for more accurate control of the air-fuel mixture for the facilitation of reduction of noxious compounds emitted from internal combustion engines and the simultaneous maximization of fuel economy and power output, have become exceedingly complex with an accompanying loss of reliability.

Thus, in order to solve the above-mentioned drawbacks, a fuel atomizing apparatus for an air-fuel delivery system which employs electrostatic attraction and repulsion, or electrostatic spray phenomenon as it will be referred to hereinafter, has been proposed by the present applicant in the U.S. patent application Ser. No. 778,994 abandoned filed on Mar. 18th, 1977.

In the above-mentioned apparatus a plurality of fine tubes which are fluidly connected to a source of fuel are arranged to open into an intake passage of, for example, an internal combustion engine. An electrode is arranged adjacent the openings of the fine tubes so that on applying a high voltage across the fine tubes and the electrode, the fuel having had a charge imparted thereto is simultaneously attracted and repulsed to and from the electrode and fine tubes respectively. The fuel is thus jetted into the intake passage to mix with and form a mist of fuel in the air passing therethrough.

The rate of discharge from the fine tubes is in the above-mentioned apparatus responsive to the voltage applied. To supply a given volume of fuel per unit time, either a small number of large diameter tubes or a rather large number of small diameter tubes are required. However, in the case of a small number of large diameter tubes, it has been found that the change in the fuel flow rate induced by a given change in the voltage applied across the electrodes is in fact undesirably small, and if the diameter is overly large there is no spray phenomenon produced. Further, in the case of a large number of small diameter tubes, although a desirable spray phenomenon is produced, the device tends to become overly complex due to the aforementioned large number of tubes and if the internal diameter of the tubes becomes too small, undesirable fluctuations in the flow rate therethrough occur. Furthermore, control efficiency drops off sharply at low voltages and the arrangement requires a greater range of voltage applied thereto, to achieve a suitable fuel flow range, as compared with the case of a small number of large tubes.

Hence, in the present invention, by using a small number of relatively large diameter tubes which are stepwisely closable by a piston which moves in response to the amount of intake air, a range of voltage which is smaller than that used in the case of many small diameter tubes can be employed.

SUMMARY OF THE INVENTION

The present invention has been developed so as to solve the above-mentioned drawbacks of the conventional apparatus. A plurality of fine tubes, the open ends of which define nozzles, are disposed in the intake passage or pipe of an internal combustion engine and a given number of nozzles are closed in accordance with an instantaneous flow rate of the intake air. An electrode is disposed adjacent to the nozzles and supplied with a high voltage with respect to that immersed in the fuel upstream of the nozzles. This high voltage is regulated by a control circuit so as to obtain a desired air/fuel ratio. With this arrangement, the quantity of the fuel which is to be atomized is controlled by both the number of the open nozzles and the supplied high voltage.

A primary object of the present invention is to provide a fuel atomizing apparatus which is simple in construction.

Another object of the present invention is to provide a fuel atomizing apparatus which provides a simple and precise control of the fuel flow rate even during rapid acceleration, deceleration and high speed operation of the engine.

A further object of the present invention is to provide a fuel atomizing apparatus which provides simple and precise control of the air/fuel ratio for maintaining a desired level.

A further object of the present invention is to provide a fuel atomizing apparatus which has an improved spray ability in case the flow rate of the fuel is low.

A further object of the present invention is to provide a fuel atomizing apparatus which suppresses the fluctuation of the flow rate of the fuel.

A still further object of the present invention is to provide a fuel atomizing apparatus which is stable and reliable in operation.

BRIEF DESCRIPTION OF THE DRAWINGS

Other features, objects and advantages of the present invention will become more clearly understood as the description of the preferred embodiments proceeds taken in conjunction with the appended drawings in which.

Corresponding parts are designated by similar reference numerals in the above-mentioned figures.

DETAILED DESCRIPTION OF THE PREFERRED EMBODIMENTS

Figure 1:
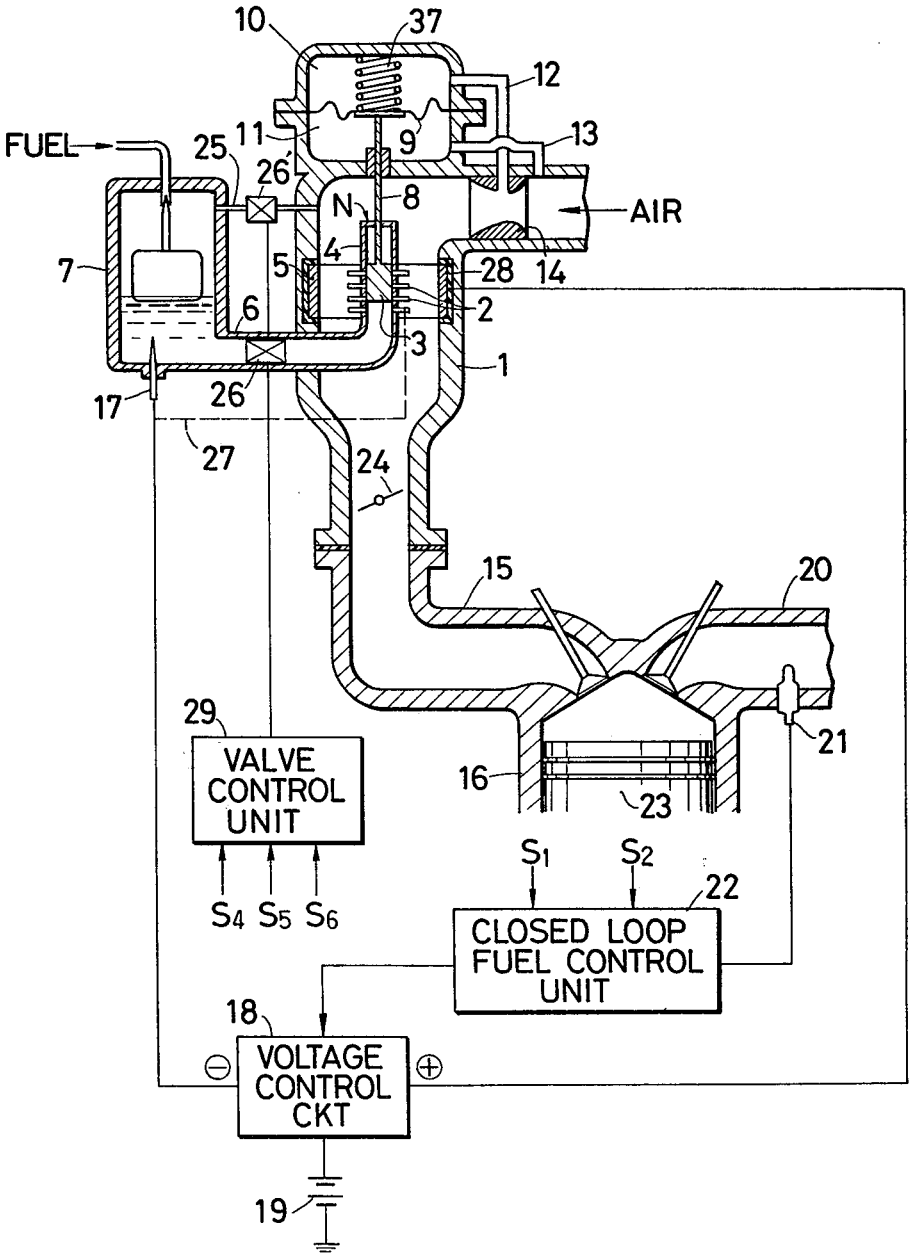
FIG. 1 is a sectional view of the first preferred embodiment according to the present invention.
Figure 2A:
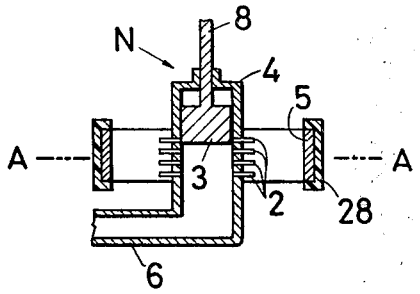
FIG. 2A is a sectional view of the variable flow rate nozzle member of the first preferred embodiment.
Figure 2B:
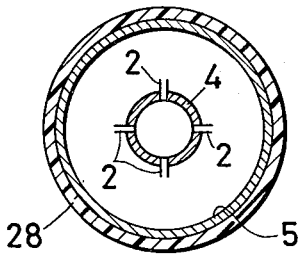
FIG. 2B is also a sectional view of the variable flow rate nozzle member of the first preferred embodiment shown in FIG. 2A taken along the line A—A'.

Reference is now made to FIGS. 1, 2A and 2B which show a first preferred embodiment. In these figures, the fuel atomizing apparatus is depicted as applied to a reciprocative internal combustion engine. A variable flow rate nozzle member generally denoted by N is disposed in the intake passage or pipe 1 which conducts air via an intake manifold 15 into a cylinder 16. The variable flow rate nozzle member N cmprises a tubular member 4, the peripheral wall of which is provided with a plurality of fine tubes 12 which define nozzles at the ends thereof and a piston 3 slidably accommodated therein, the piston 3 being fixedly connected to a rod 8. The fine tubes 2 are formed of electrically conductive material or materials and arranged to extend radially outwardly from and longitudinally along the peripheral wall of the tubular member 4.

An annular electrode 5 is insulatingly disposed in an annular recess formed in the inner surface of the intake pipe 1 via an insulating bushing 28 so as to be adjacent to the openings of the fine tubes 2. The electrode 5 is arranged to be supplied with one of either a positive or negative high voltage. In this embodiment, a positive high voltage is shown connected to the electrode 5. One end of the tubular member 4 is fluidly connected to a float chamber 7 via a fuel conduit 6 which has a solenoid valve 26 disposed therein. The solenoid valve 26 is arranged to shut the conduit 6 when energized. Besides the first annular electrode 5 disposed adjacent to the openings of the fine tubes 2, a second electrode 17 is disposed in the float chamber 7 so that on a high voltage (as an example from several kilovolts to several tens of kilovolts) being connected across these two electrodes 5 and 17, atomizing and jetting of the fuel by the electrostatic spray phenomenon from the openings of the fine tubes 2 occurs. A negative voltage is supplied to the second electrode 17 in this embodiment.

The piston 3 disposed in the tubular member 4 of the variable flow rate nozzle member N is fixedly connected to a diaphragm 9 via a rod 8. The diaphragm 9 is as shown sealingly disposed between a pair of cup-shaped members to define variable volume fluid chambers 10 and 11. As shown, the diaphragm is biased in the direction of the chamber 11 by a compression spring 37. The chamber 10 is fluidly communicated with a venturi 14 formed in the intake pipe 1 so as to expose the chamber 11 to the variable vacuum developed therein during running or operating of the engine. The chamber 11 is arranged to communicate with a portion of the intake pipe located immediately upstream of the venturi 14. With this arrangement, the pressure prevailing upstream of the venturi is transmitted to the chamber 11 thereby creating a pressure differential across the aforementioned diaphragm 9 during running of the engine. The intake pipe 1 is further arranged to communicate via an intake manifold 15 with the cylinder 16 of the engine. A piston 23 is sealingly and slidably accommodated in the cylinder 16 so as to form a combustion chamber. A throttle valve 24 is positioned within the intake pipe 1 downstream of the tubular member 4.

In the fuel atomizing apparatus shown in FIG. 1, the fuel is atomized into fine particles upon being jetted into the air intake pipe 1 from the nozzles of the fine tubes 2 of the variable flow rate nozzle member N due to electrostatic spray phenomenon. Since the air intake pipe 1 and the upper portion of the float chamber 7 are communicated by a pipe 25 for equilibrating the air pressure existing in both portions, the fuel jets from the openings of the fine tubes 2 under the influence of only the electrostatic forces induced by the electrodes 5 and 17. The pipe 25 has a solenoid valve 26' disposed therein, the solenoid valve 26' being energized simultaneously when the other solenoid valve 26 disposed in the fuel conduit 6 is energized for blocking the vapour of the fuel or the fuel per se flowing into the intake pipe 1 in accordance with the engine operational conditions.

During running of the engine, the diaphragm 9 is urged toward the chamber 10 against the force of spring 37 by the difference in air pressure between two chambers 10 and 11 produced by air flow through the venturi 14. The piston 3 is thus moved reciprocatively in the cylindrical portion of the tubular member 4 in accordance with movement of the diaphragm 9 and thus selectively closes a number of the openings of the fine tubes 2 which open to the air intake pipe 1. It will thus be understood that since the flow rate of the fuel which is jetted from the plurality of nozzles varies in accordance with the number of openings provided by the fine tubes 2, the flow rate of the fuel varies in accordance with the flow rate of the intake air.

Although the venturi 14 is used for detecting the flow rate of the intake air in the embodiment shown in FIG. 1, a suitable orifice may be disposed in the intake passage in place of the venturi 14. When such an orifice is provided in the intake pipe, the chamber 11 is arranged to communicate with a portion of the intake pipe located immediately upstream of the orifice, while the chamber 10 is arranged to communicate with a portion of the intake pipe located immediately downstream of the orifice. With this provision, the diaphragm 9 is operated in the same manner as in the case of using the venturi 14, in accordance with the pressure difference between the upstream and downstream portions of the orifice.

A voltage control circuit 18 is supplied with DC power from power supply 19 and a signal from a closed loop control unit 22. The voltage control circuit 18 controls the high voltage which is to be supplied across the electrodes 5, 17 in response to the signal of the closed loop control unit 22. Thus the flow rate of the fuel can be precisely controlled in accordance with the variation of the signal from the closed loop circuit 22.

Figure 3:
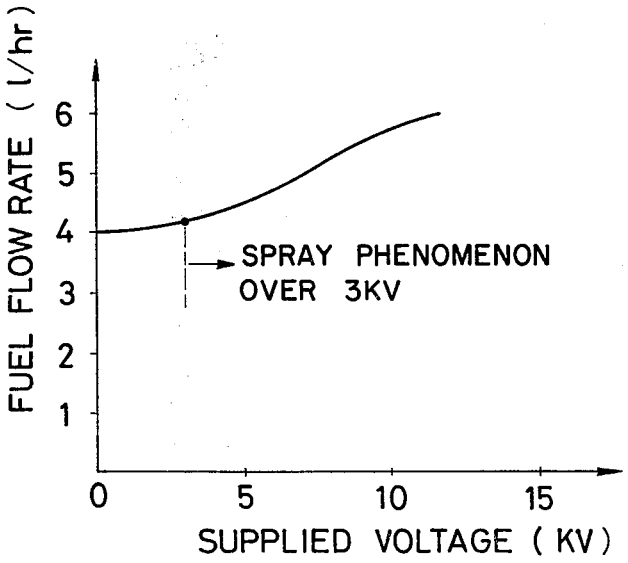
FIG. 3 is a co-ordinate diagram showing the relation between the supplied voltage and the flow rate of the fuel.

FIG. 3 shows the relation between the supplied voltage and the flow rate of the fuel which jets from the fine tubes 2. The flow rate of the fuel increases as the supplied voltage increases and it is noted that the fuel obtains sufficient kinetic energy to be atomized into fine particles over 3 kilovolts in this embodiment.

Figure 4:
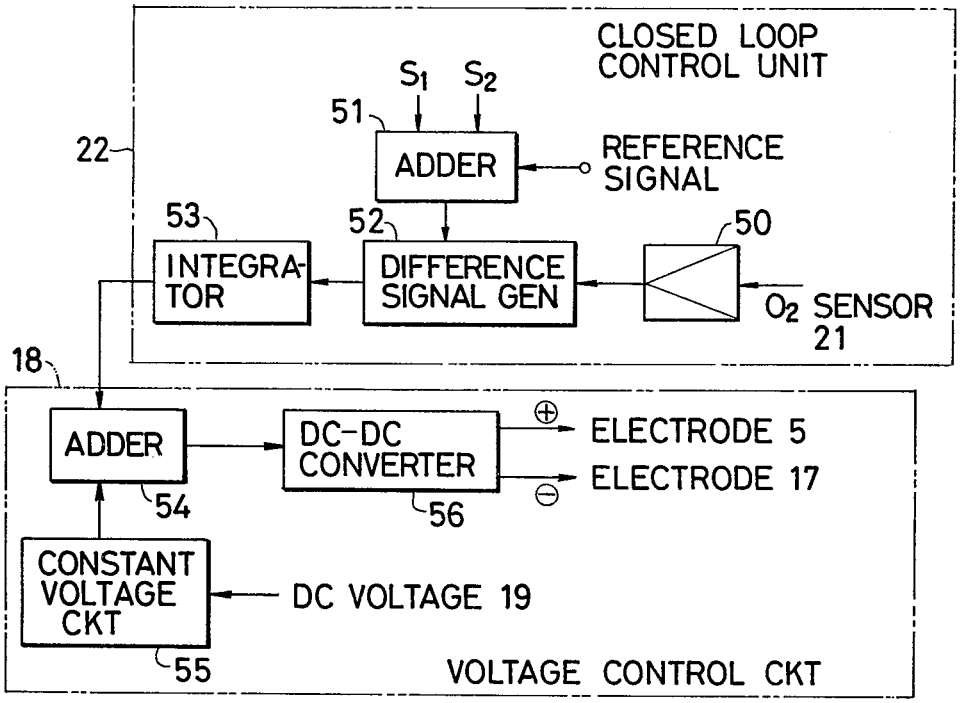
FIG. 4 is a block diagram of the closed loo ` control unit and the voltage control circuit according to the present invention.

Reference is now made to FIG. 4 which shows in block diagram form the closed loop control unit 22 and the voltage control circuit 18. The input of an amplifier 50 is connected to a gas sensor 21 shown in FIG. 1 such as an $O_2$ sensor disposed in an exhaust manifold 20. The output of the amplifier 50 is connected to a difference signal generator 52 which is also connected to a first adder 51 which receives a first reference signal as well as signals representative of engine parameters $S_1$, $S_2$ such as engine rotational speed and intake air flow rate. The output of the difference signal generator 52 is coupled to an input of an integrator 53 the output of which is connected to one of the inputs of a second adder 54. The other input of the second adder 54 is coupled to an output of a constant voltage circuit 55 which is in turn connected to the DC power supply 19. The output of the second adder 54 is connected to a DC-DC converter 56, the outputs of which are connected to the electrodes 5 and 17.

The function and the operation of the closed loop control unit 22 and the voltage control circuit 8 are described hereinbelow. The amplifier 50 amplifies a signal representative of the concentration of a component such as oxygen ($O_2$) contained in the exhaust gas which is indicative of the instantaneous air/fuel ratio of the air-fuel mixture being supplied to the cylinder 16. The reference signal applied to the first adder 51 is selected so as to represent a desired air/fuel ratio which is close to the stoichiometric air/fuel ratio and thus the magnitude of the reference signal is maintained constant as long as operational conditions of the engine are unchanged. However, the reference signal is mixed with signals $S_1$ and $S_2$ which are representative of engine parameters in view of change of engine operational conditions. The first adder 51 produces the modified reference signal at its output which is fed to the difference signal generator 52. The difference signal generator 52 produces an output signal proportional to the difference in magnitude between the two input signals, i.e. the output signal of the amplifier 50 and the modified reference signal. The magnitude of the output signal of the difference signal generator 52 represents deviation of the instantaneous air/fuel ratio from a desired level with respect to the engine conditions. The output signal of the difference signal generator 52 is fed to the second adder 54 via an integrator 53. A constant voltage circuit 55 produces a regulated and thus constant voltage by using the DC voltage supplied from the DC power supply 19. The second adder 54 superposes the integrated difference signal on the constant voltage from the circuit 55. It is now to be noted that both of the input signals of the second adder 54 are low voltage signals. Therefore the output voltage of the adder 54 is also low voltage fluctuating around, for example, 10 volts. The output signal of the adder 54 is then applied to the DC-DC converter 56 in which the low voltage input signal is converted into a high voltage which is, for example, from several kilovolts to several tens of kilovolts. The DC-DC converter 56 is of course a well known circuit wherein a low DC voltage is boosted to a high DC voltage.

Since the output voltage of the DC—DC converted 56 is proportional to the input low voltage, the output high voltage is controlled in proportion to the output signal of the closed loop unit 22. The output high voltage of the DC—DC converter, i.e. the output of the voltage control circuit 18 is connected across the electrodes 5, 17.

It will be understood that the controlling of the flow rate of fuel by the variable high voltage which is varied in such a manner as to compensate for any deviation of the air/fuel ratio from a desired air/fuel ratio contributes to maintain an optimum air/fuel ratio under various conditions of the engine operation.

If, in the above-mentioned arrangement, the signals $S_1$, $S_2$ representative of engine parameters are not supplied to the first adder 51 or the values of the signals $S_1$, $S_2$ are zero, then the reference signal is fed to the difference signal generator 52 without modification so that the difference signal generator 52 produces a signal proportional to the deviation of the air/fuel ratio from the desired air/fuel ratio which is close to the stoichiometric air/fuel ratio.

As seen from the above-described explanation, the control circuit 18 controls the output voltage which is impressed across the electrodes 5, 17 disposed adjacent to the openings of the fine tubes 2 and the float chamber 7 respectively, in accordance with the above-mentioned engine parameters so that the flow rate of the fuel supplied to the cylinder 16 from the float chamber 7 via fine tubes 2 can be precisely and simply controlled. The fuel atomizing apparatus according to the present invention may be further designed to increase the flow rate of the fuel by raising the supplied voltage in proportion to the rate of angular displacement of the throttle valve 24.

In the fuel atomizing apparatus according to the present invention, the coarse control of the flow rate of the fuel is preferably carried out by the movement of the piston 3 where the piston 3 selectively shuts the openings of the fine tubes 2 while the fine control of same is carried out by variation of the supplied voltage. Namely, the amount of the supplied fuel is roughly controlled by movement of the piston 3 and precisely regulated by the high voltage between the electrodes 5 and 17. Since the supplied voltage varies in order to perform the precise control of the fuel flow rate, the range of voltage may be reduced compared to the conventional apparatus.

It will be appreciated that since it is not required to employ a wide range of voltage as mentioned above, the diameter of the each opening of the fine tubes 2 can be, for example, approximately 0.2 mm to 0.4 mm which is appreciably larger than the conventional apparatus. Consequently, the control ability at a low fuel flow rate through the fine tubes i.e. when a low voltage supplied to the electrodes, is improved so that this arrangement suppresses the fluctuation of the jetted quantity of the fuel which is caused by the physical property of the fuel. Therefore the stability of the fuel flow is also improved. With this arrangement, the number of the fine tubes 2 can be reduced with respect to conventional apparatus which does not include means for coarse control such as piston 3 as in the present invention. Since the number of the fine tubes 2 is less than that of the conventional apparatus, the construction of the fuel control apparatus of the present invention is simplified.

Returning to FIG. 1, the electromagnetic solenoid valve 26 is electrically connected to a valve control unit 29 which produces a control signal in response to a plurality of signals denoted by $S_4$, $S_5$ and $S_6$ respectively representative of the ON/OFF position of the ignition switch, engine speed and angular position of the throttle valve 24 so that the electromagnetic solenoid valve 26 closes when the engine stops or the throttle valve 24 is fully closed at a high engine speed for blocking fuel flow.

Figure 5:
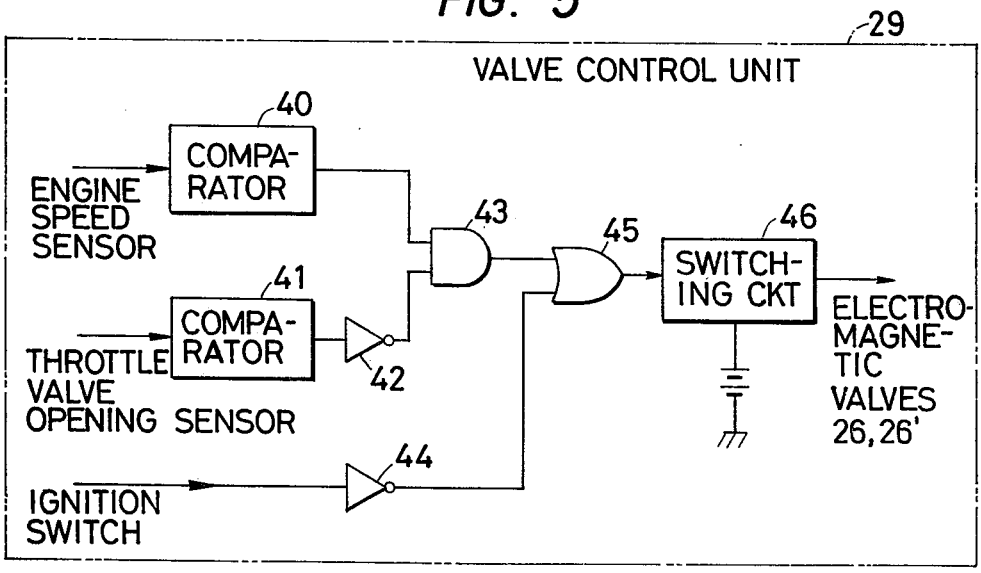
FIG. 5 is a block diagram of the valve control unit according to the present invention.

FIG. 5 shows an example of the circuitry of the valve control unit 29. First and second comparators 40, 41 are connected at their inputs to an engine speed sensor (not shown) and a throttle valve opening or angular displacement sensor (not shown) respectively. Both the first and second comparators 40, 41 produce output signals respectively when the magnitude of the input signals are respectively greater than predetermined values. The output signal of the first comparator 40 is fed to an AND gate 43 and the output signal of the second comparator 41 through an inverter 42 is fed to the other input terminal of the same AND gate 43. Consequently, the AND gate produces a logic "1" signal at its output when both of the input terminals are supplied with logic "1" signals. Therefore, when the throttle valve 24 is fully closed and the engine rotates at high speed, the AND gate produces its output or logic "1" signal, which is fed to a switching circuit 46 via an OR gate 45. A second inverter 44 is connected to an ignition switch and produces a logic "1" signal at its output when the ignition switch is turned off and thus this signal is fed to the switching circuit 46 through the OR gate 45. Upon receiving the above-mentioned signal from the OR gate 45 the switching circuit 46 energizes the electromagnetic solenoid valve 26 shown in FIG 1 to close same.

The electrode 17 disposed in the float chamber 7 may be omitted if the fine tubes are made of electroconductive material to function as electrodes and the aforementioned negative high voltage with respect to the electrode 5 is supplied via the broken line 27 shown in FIG. 1. Of course it is possible to supply the negative high voltage to both the electrode 17 and the fine tubes 2 for effectively supplying the high voltage.

The arrangement of the fine tubes 2 can have several variations with respect to the diameter of the openings of the fine tubes and the number of same per unit area. The diameters of the openings may increase gradually along a direction from the downstream portion to the upstream portion or vice versa or the number of the openings per unit area may become higher gradually from the downstream portion to the upstream portion or vice versa.

Figure 6:
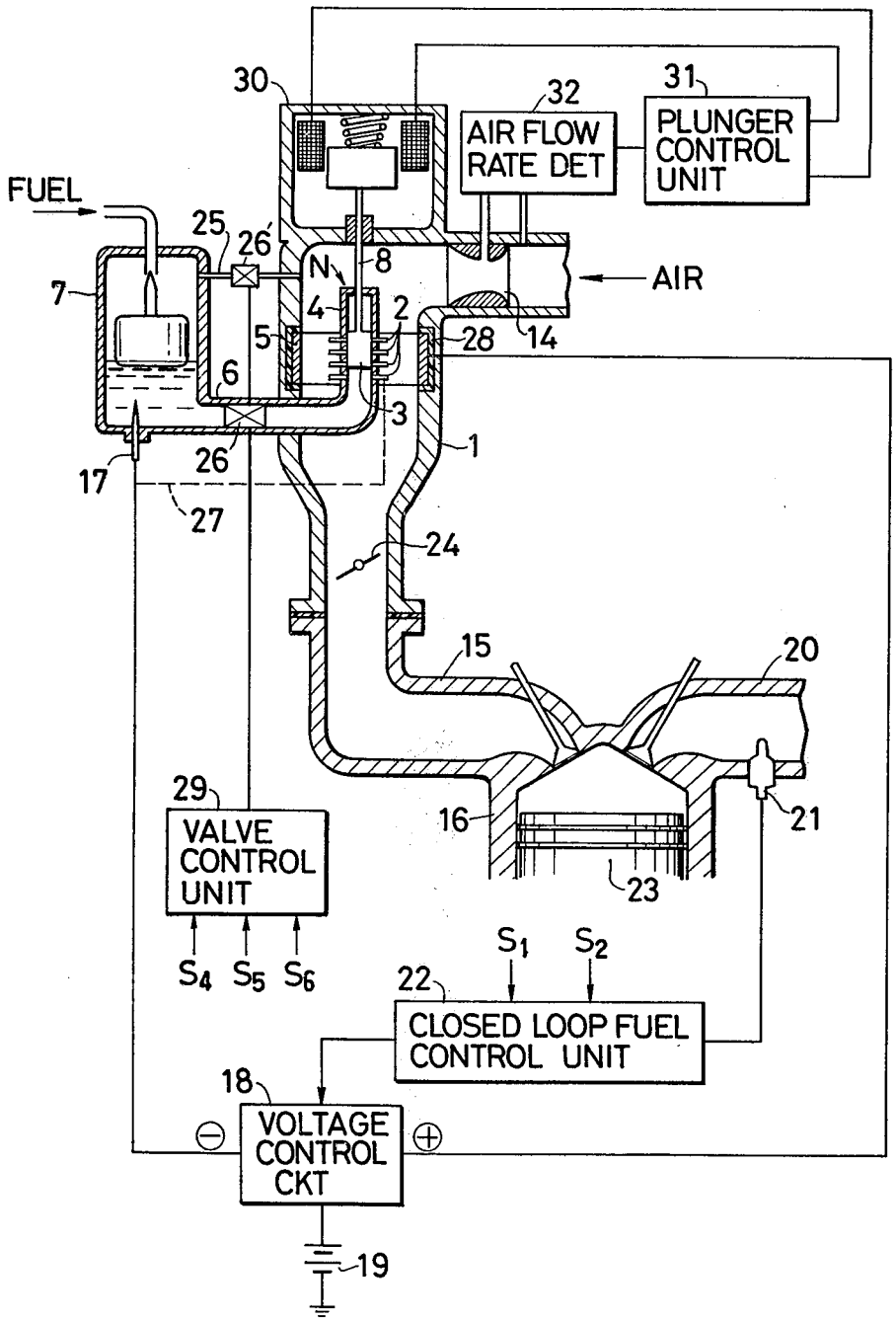
FIG. 6 is a sectional view of the second preferred embodiment according to the present invention.

Reference is now made to FIG. 6 which shows a second embodiment according to the present invention. In this embodiment a movable member (no numeral) of an electromagnetic plunger unit 30 is connected to the rod 8 for the purpose of replacing the diaphragm arrangement shown in the first embodiment of FIG. 1. The electromagnetic plunger unit 30 receives a plunger control signal from a plunger control unit 31 which produces the plunger control signal in accordance with a signal representative of the flow rate of the intake air detected by an air flow rate detector 32. The flow rate detector 32 generates the signal by detecting the difference in pressure of the intake air between the venturi 14 and an upstream portion of same. Thus the piston 3 is actuated and slides in the tubular member 4 of the variable flow rate nozzle member N for selectively shutting off some of the fine tubes 2 in the same manner as in the first embodiment. The remainder of the arrangement is the same as the first embodiment. The remainder of the arrangement is the same as the first embodiment and the corresponding elements or parts are designated by the same numerals.

The venturi 14 may be omitted if a suitable orifice is provided in the intake pipe to produce pressure difference across the orifice.

Figure 7:
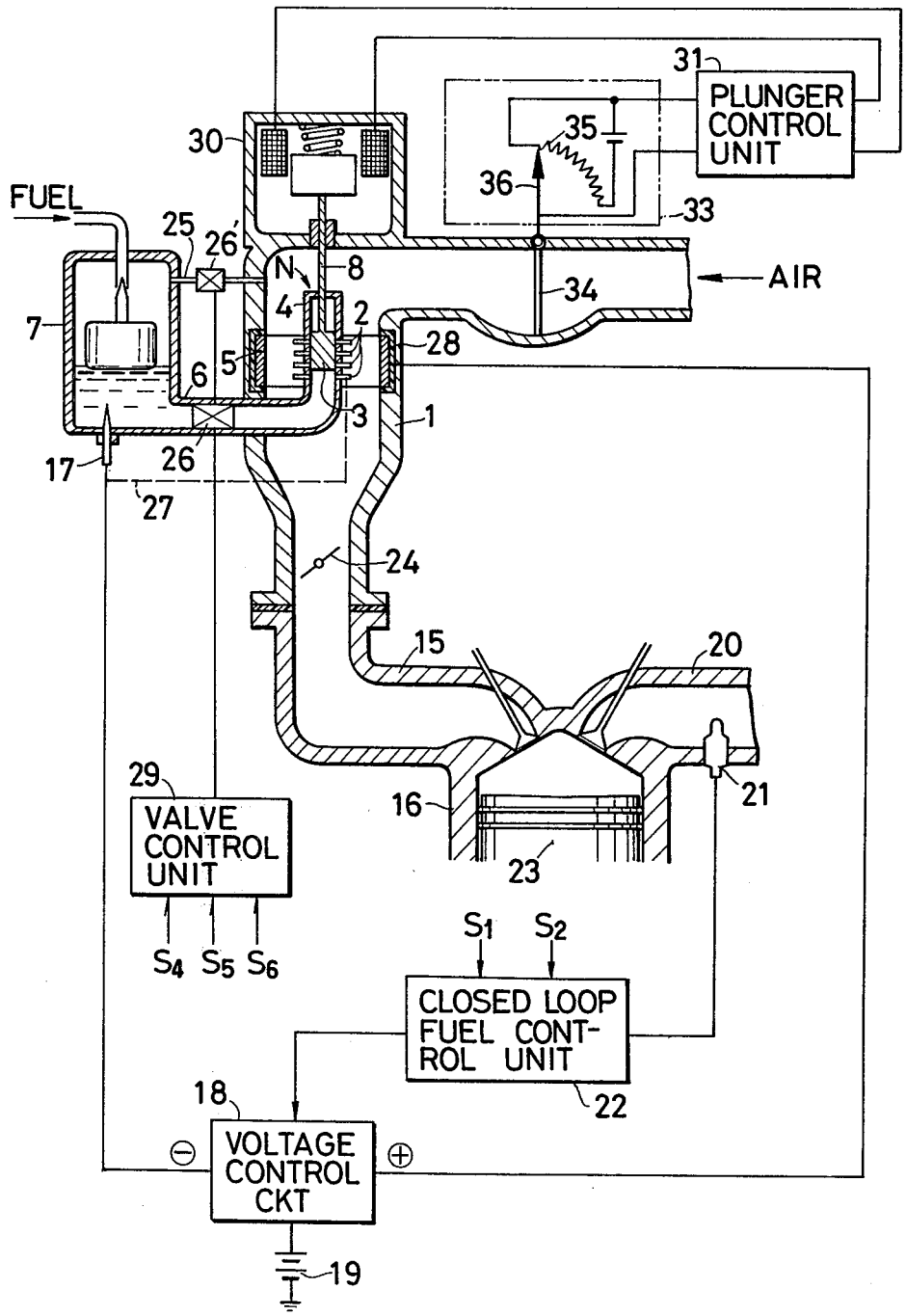
FIG. 7 is a sectional view of the third preferred embodiment according to the present invention.

Reference is now made to FIG. 7 which shows a third embodiment which has a construction similar to the second embodiment of FIG. 6 except that the flow rate of the intake air is detected by an air flow rate detector 33. In this arrangement a flap 34 is pivotally disposed in the intake pipe 1 and arranged to rotatively move in the direction of the downstream portion of the intake pipe 1 by a biasing force of an airflow induced into the intake pipe. A movable contact 36 arranged to slide on a resistor 35 of a potentiometer is fixedly connected to the flap 34 and is arranged to obtain a voltage which is variable in accordance with the angular displacement of the flap 34. Since the voltage obtained by the potentiometer 35 is in proportion to the angular displacement of the flap, the voltage indicates the flow rate of the intake air. The output voltage of the air flow rate detector 33 is then fed to a plunger control unit 31 the function of which is the same as the second embodiment described hereinbefore so that a description of the function thereof is omitted.

The fuel injection apparatus as described hereinbefore is designed to control the flow rate of the fuel by using the piston 3 which slides in response to the flow rate of the intake air for coarse control and varying the supplied voltage which varies in response to the instantaneous deviation of an air/fuel ratio from an aimed level for fine control. Namely, the coarse control of the flow rate is performed by mechanical means and the fine control is performed by electrical means. However, it is also possible to arrange the fuel atomizing apparatus in a manner that the coarse control and the fine control are reversed, by increasing the number of the fine tubes and further making the internal diameter of same small. With this arrangement the coarse control of the flow rate is carried out by the variation of the supplied voltage and the fine control by the mechanical means viz. the piston 3 disposed in the tubular member 4.

What is claimed is:

1. A fuel atomizing apparatus for an internal combustion engine, comprising:

(a) nozzle means disposed in the intake passage of said internal combustion engine, said nozzle means comprising a tubular member which includes a plurality of nozzles formed longitudinally and radially on a peripheral wall thereof, said tubular member being fluidly connected via a fuel conduit to a source of fuel;

(b) electrode means so constructed and arranged to induce said fuel to discharge from said nozzle means when supplied with a high voltage;

(c) sensor means for producing a signal inductive of the flow rate of the intake air of said engine;

(d) piston means slidably accommodated in said tubular member; and (e) motor means responsive to said signal for actuating said piston means so that said piston means moves longitudinally in said tubular member, and the distance of the movement of said piston varies in accordance with the magnitude of said signal derived from said sensor means.

2. A fuel atomizing apparatus as claimed in claim 1 further comprising:

voltage supply means which is so constructed and arranged as to supply said electrode means with said high voltage in accordance with operational conditions of said internal combustion engine.

3. A fuel atomizing apparatus as claimed in claim 1 wherein said tubular member is fluidly connected via a fuel conduit to a float chamber containing fuel.

4. A fuel atomizing apparatus as claimed in claim 3, wherein said electrode means comprises first electrode means disposed adjacent to the openings of said nozzles and second electrode means so constructed and arranged as to contact with the fuel contained in said float chamber, said fluid conduit and said nozzles.

5. A fuel atomizing apparatus as claimed in claim 3, wherein said means for selectively shutting off the nozzles is a vacuum motor means which comprises a piston slidably accommodated in the tubular member, a diaphragm fixedly connected to said piston, first and second chambers located on opposite sides of said diaphragm respectively, said first chamber being communicated with a venturi portion disposed in the intake passage, said second chamber being communicated with an upstream portion of the venturi portion, and biasing means provided in said first chamber for biasing said diaphragm in the direction of said second chamber.

6. A fuel atomizing apparatus as claimed in claim 3, wherein said means for selectively shutting off the nozzles is a vacuum motor means which comprises a piston slidably accommodated in the tubular member, a diaphragm fixedly connected to said piston, said diaphragm defining first and second chambers on either side thereof, said first chamber being communicated upstream of an orifice disposed in the intake passage, said second chamber being communicated downstream of said orifice, and biasing means provided in said first chamber for biasing said diaphragm in the direction of said second chamber.

7. A fuel atomizing apparatus as claimed in claim 2, wherein said voltage supply means comprises a closed loop control unit for producing an output signal representative of deviation of the instantaneous air/fuel ratio from a desired level, and a voltage control circuit connected to said closed loop control circuit for generating a high voltage output the magnitude of which variable in response to said output signal representative of the deviation.

8. A fuel atomizing apparatus as claimed in claim 4, wherein said second electrode means is an electrode disposed in the float chamber.

9. A fuel atomizing apparatus as claimed in claim 4, wherein said nozzles are made of electro-conductive material and said second electrode means is said nozzles.

10. A fuel atomizing apparatus as claimed in claim 9, wherein said second electrode means includes an electrode disposed in the float chamber and electrically connected to said nozzles.

11. A fuel atomizing apparatus as claimed in claim 3, wherein the upper portion of said float chamber is communicated with said intake passage for equilibrating the air pressure.

12. A fuel atomizing apparatus as claimed in claim 3, further comprising an electromagnetic solenoid valve disposed in said fuel conduit for blocking the fuel flow when energized, and a valve control unit for energizing said solenoid valve in accordance with operational conditions of said engine.

13. A fuel atomizing apparatus for an internal combustion engine, comprising:

(a) nozzle means disposed in the intake passage of said internal combustion engine which is so constructed and arranged as to discharge fuel supplied thereinto from a source of fuel into said intake passage, said nozzle means comprising a tubular member which includes a plurality of nozzles formed longitudinally and radially on a peripheral wall thereof, said tubular member being fluidly connected via a fuel conduit to a float chamber containing fuel;

(b) electrode means so constructed and arranged as to induce said fuel to discharge from said nozzle means when supplied with a high voltage; and (c) means for selectively shutting off said nozzle means, said means being so constructed and arranged as to vary the amount of fuel dischargeable from said nozzle means in accordance with flow of air, said means for selectively shutting off said nozzle comprising a piston slidably accommodated in the tubular member, an electromagnetic plunger fixedly connected to said piston for moving the same, said electromagnetic plunger being actuated by a plunger control signal, a plunger control unit for supplying said plunger control signal in response to a flow rate signal representing flow rate of the intake air, and flow rate detecting means for producing said flow rate signal.

14. A fuel atomizing apparatus as claimed in claim 13, wherein said flow rate detecting means is a pressure detector which detects the difference in pressure existing in the venturi portion disposed in the intake passage and a portion of an intake passage upstream of said venturi.

15. A fuel atomizing apparatus as claimed in claim 13, wherein said flow rate detecting means is a pressure detector which detects the difference in pressure existing upstream and downstream of an orifice disposed in the intake passage.

16. A fuel atomizing apparatus as claimed in claim 13, wherein said flow rate detecting means is a flow rate detector comprising a flap member swingably disposed in the intake passage and a potentiometer supplied with a constant voltage at the both ends thereof and having the slide contact thereof operatively connected to said flap member to be movable thereby, thus to produce said flow rate signal across the slide contact and one of the ends thereof.

17. A fuel atomizing apparatus for an internal combustion engine, comprising:

(a) nozzle means disposed in the intake passage of said internal combustion engine, which nozzle means is so constructed and arranged as to discharge fuel supplied thereto from a source of fuel into said intake passage;

(b) electrode means so constructed and arranged as to induce said fuel to discharge from said nozzle means when supplied with a high voltage;

(c) voltage supply means which is so constructed and arranged as to supply said electrode means with said high voltage in accordance with operational conditions of said internal combustion engine; said voltage supply means including a closed loop control unit for producing an output signal representative of deviation of the instantaneous air/fuel ratio from a desired level, and a voltage control circuit connected to said closed loop circuit for generating a high voltage output, the magnitude of which is variable in response to said output signal representative of the deviation; said closed loop control unit including a reference signal generator for producing a reference signal representative of said desired level, an air/fuel ratio detector including a gas sensor disposed in the exhaust passage for producing an air/fuel ratio signal representative of said instantaneous air/fuel ratio, and a difference signal generator for producing said output signal representative of the difference between said reference and air/fuel ratio signals; and (d) means for selectively shutting off said nozzle means, said means being so constructed and arranged as to vary the amount of fuel dischargeable from said nozzle means in accordance with flow of air.

18. A fuel atomizing apparatus as claimed in claim 17, wherein said gas sensor is an oxygen sensor.

19. A fuel atomizing apparatus as claimed in claim 17, wherein said reference signal is constant and representative of the desired air/fuel ratio which is close to stoichiometric air/fuel ratio.

20. A fuel atomizing apparatus as claimed in claim 17, wherein said reference signal varies in accordance with operational conditions of said engine.

21. A fuel atomizing apparatus for an internal combustion engine, comprising:

(a) nozzle means disposed in the intake passage of said internal combustion engine which is so constructed and arranged as to discharge fuel supplied thereinto from a source of fuel into said intake passage, said nozzle means comprising a tubular member which includes a plurality of nozzles formed longitudinally and radially on a peripheral wall thereof, said tubular member being fluidly connected via a fuel conduit to a float chamber containing fuel, the upper portion of said float chamber being communicated with said intake passage for equilibrating the air pressure;

(b) an electromagnetic solenoid valve disposed between said upper portion of said float chamber and said intake passage;

(c) electrode means so constructed and arranged as to induce said fuel to discharge from said nozzle means when supplied with a high voltage; and (d) means for selectively shutting off said nozzle means, said means being so constructed and arranged as to vary the amount of fuel dischargeable from said nozzle means in accordance with flow of air.

* * * * *